United States Patent [19]

Myers et al.

[11] 4,442,433

[45] Apr. 10, 1984

[54] ADAPTIVE SIGNAL PROCESSING APPARATUS

[75] Inventors: Michael H. Myers, Scottsdale; Sam Daniel, Tempe, both of Ariz.

[73] Assignee: Motorola Inc., Schaumburg, Ill.

[21] Appl. No.: 394,082

[22] Filed: Jul. 1, 1982

[51] Int. Cl.[3] ..... G01S 3/16; G01S 3/28

[52] U.S. Cl. ..... 343/378

[58] Field of Search ..... 343/100 LE, 100 CL; 455/278

[56] References Cited

U.S. PATENT DOCUMENTS 4,286,268 8/1981 Daniel et al. ..... 343/100 LE

*Primary Examiner*—Theodore M. Blum

*Attorney, Agent, or Firm*—Eugene A. Parsons

[57] ABSTRACT

An array of signals is adapted and dithered by use of a weight signal, a gradient signal with a carrier at a first frequency and an orthogonal sequence signal with a carrier at a second frequency, the dithered signals are then operated on to extract an output signal, a gradient signal, and a weight signal, which gradient and weight signals along with a generated orthogonal sequence signal, are then fed back for use in the dithering process. The carriers at different frequencies provide separability of predetermined components during the operation.

9 Claims, 5 Drawing Figures

ADAPTIVE SIGNAL PROCESSING APPARATUS

BACKGROUND OF THE INVENTION

In adaptive signal processing, a variety of apparatus has been proposed for arriving at the desired signal output. In U.S. Pat. No. 4,236,158, issued Nov. 25, 1980, and entitled "Steepest Descent Controller For An Adaptive Antenna Array", apparatus for producing a steepest descent control is disclosed. The steepest descent control is a very desirable method of achieving the required output signal, but the apparatus can be relatively expensive and complicated. A second type of control, known as an accelerated gradient control, is disclosed in an article entitled "Improved Feedback Loop for Adaptive Arrays", Proceedings of the IEEE on Aerospace and Electronics Systems, Vol. AES-16, No. 2, March 1980, by R. T. Compton, Jr. Again, the accelerated gradient control can be relatively expensive. The cost of the above systems can be reduced in accordance with apparatus disclosed in U.S. Pat. No. 4,286,268, issued Aug. 25, 1981, entitled "Adaptive Array with Optimal Sequential Gradient Control". In this patent many of the components are time-shared to substantially reduce the costs thereof.

The use of weight dithering in adaptive arrays has been suggested previously to achieve low cost implementation by eliminating IF hardware, at the expense of slower and often less stable convergence and narrower bandwidths.

DESCRIPTION OF THE PREFERRED EMBODIMENT

The present invention pertains to a method and apparatus for realizing optimal control in gradient and accelerated gradient relaxation in adaptive nulling systems by a weight dithering technique. The implementation can be digital, hybrid or analog and includes means coupled to receive a weight signal, a gradient signal and an orthogonal sequence signal for dithering input signals in accordance with the combined weight, gradient and orthogonal sequence signals and means coupled to the first means for separating components of the dithered signals to develop an output signal, a weight signal and a gradient signal. The separability of the components are further improved by impressing the gradient signal on a carrier of a first frequency and the orthogonal sequence signals on a carrier of a second frequency different than the first frequency.

It is an object of the present invention to provide new and improved adaptive signal processing apparatus.

It is a further object of the present invention to provide new and improved adaptive signal processing apparatus which is relatively low-cost to implement.

It is a further object of the present invention to provide adaptive signal processing apparatus which is especially advantageous in situations where recovery of the baseband is impractical.

These and other objects of this invention will become apparent to those skilled in the art upon consideration of the accompanying specifications, claims and drawings.

BRIEF DESCRIPTION OF THE DRAWINGS

Referring to the drawings.

DESCRIPTION OF THE PREFERRED EMBODIMENTS

Figure 1:
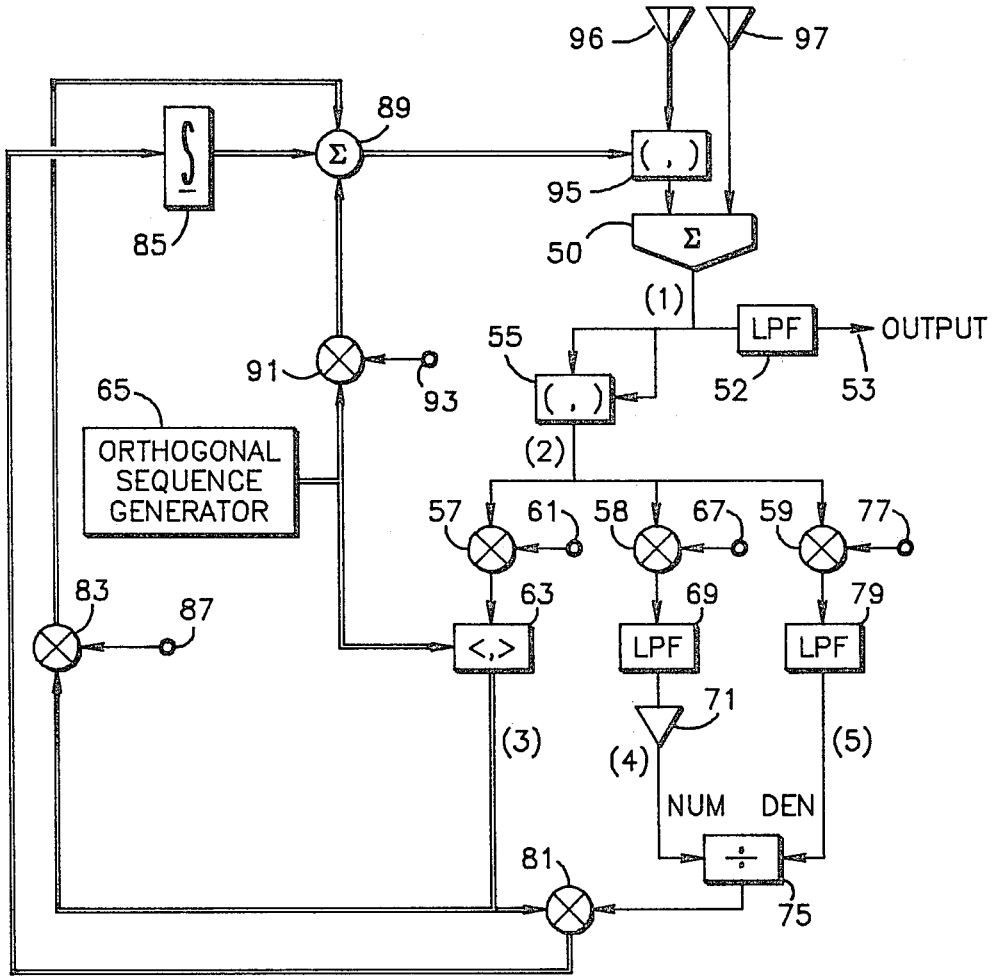
FIG. 1 is a simplified block diagram of steepest descent gradient controlled adaptive signal processing apparatus embodying the present invention.

Throughout the various embodiments disclosed for the present invention the inputs to the adaptive signal processing apparatus will be disclosed as a main antenna and a plurality of secondary antennas, but it should be understood that this is simply a convenient operable embodiment and the adaptive signal processing apparatus could be utilized with a variety of signal arrays without detracting or altering, substantially, the operation thereof. Also, in the description of the various embodiments signals available at the output/input of various components will be set forth in the specification and marked in the drawings with an appropriate number contained in parenthesis for ease of identification. Similar signals will be marked with similar numbers throughout the various embodiments. A complete mathematical analysis of the steepest descent controller for adaptive signal processing apparatus is disclosed in the above identified U.S. Pat. No. 4,236,158 and any mathematics required in the present description which is not completed herein is incorporated by reference. Further, the following notations and definitions will be utilized throughout the present description.

$s_o$=scalar complex-valued signal at unweighted port s=N-component complex-valued vector at weighted auxiliary ports $s_c$=scalar complex-valued combined signal without dithering $\gamma$=N-component complex-valued gradient vector $\lambda$=scalar real-valued open-loop gain w=N-component complex-valued weight vector $T_s$=integration time $(1/T_s)$=desired signal bandwidth $\Delta$=N-component real valued dither signal vector $[\delta_1, \delta_2, \ldots, \delta_N]^T$ with the following properties:

$$\frac{1}{T_s}\int_{t-T_s}^{t} \delta_i(\tau)\,\delta_j(\tau)\,d\tau = \begin{cases} 0; & i \neq j \\ \delta^2; & i = j \end{cases}$$

$$\langle \Delta, \Delta^T \rangle_{T_s} = \delta^2 I$$
$$\langle \Delta^T, \Delta \rangle_{T_s} = N\delta^2$$

where $\delta$ is the amplitude of the square waves $\{\delta_i(\tau)\}_{i=1}^{N}$ and I is the identity matrix of order N.

Figure 3:
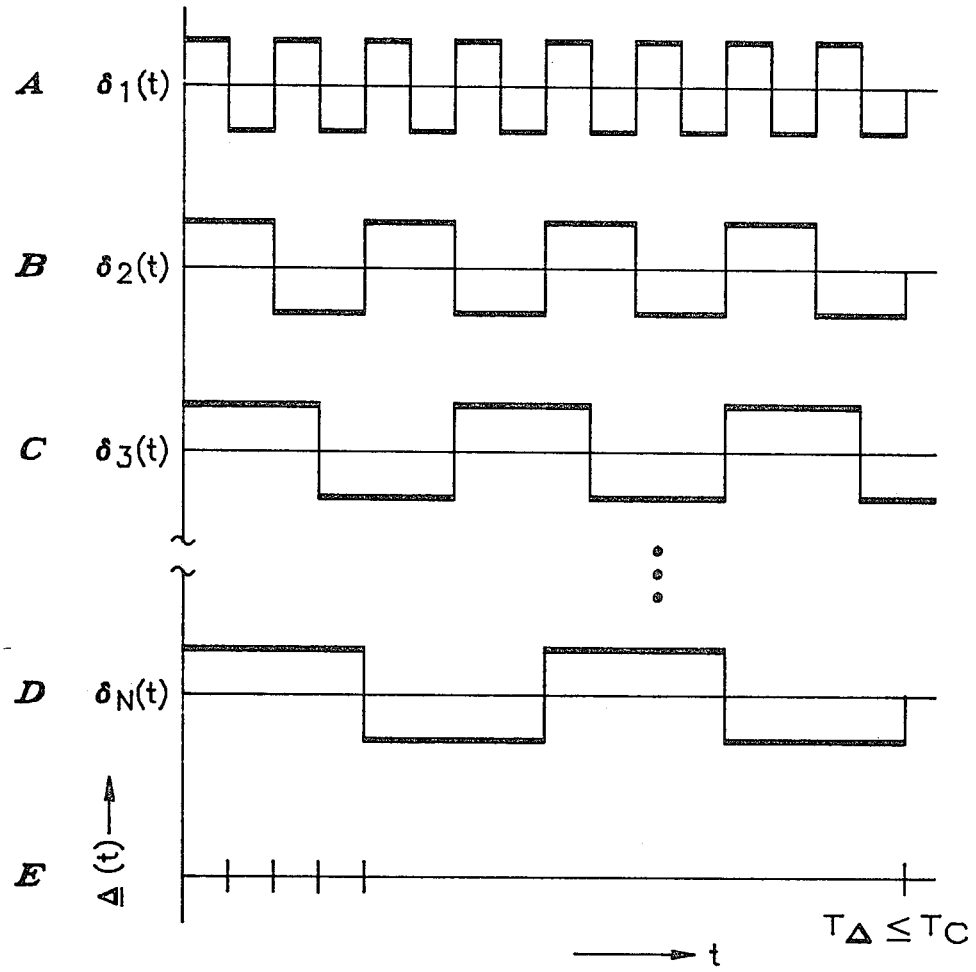
FIG. 3 illustrates an example of orthogonal sequence signals utilized in FIG. 1.

Referring specifically to FIG. 1, steepest descent gradient control adaptive signal processing apparatus is disclosed which apparatus is essentially a closed loop and, therefore, a description of the apparatus and operation thereof will begin at the output of a summation circuit 50 for convenience. The combined output signal provided by the summation circuit 50 is defined by the mathematical statement $$\tilde{s}_c = s_c + s^T\Delta e^{j\omega 1t} + \beta s^T\gamma e^{j\omega 2t} \quad (1)$$

where $s_c = s^T w + s_o$ is the undithered output signal and $\Delta(t)$ is typically shown in FIG. 3.

The output signal from the circuit 50 is supplied through a lowpass filter 52 to an output terminal 53. The filter 52 removes the higher order terms and allows only the term $s_c$, which is combined array output with no dithering, to appear at the output terminal 53. The output signal of the circuit 50 is also applied to both inputs of a multiplying circuit 55. Without loss of generality, this embodiment illustrates all signals originating at baseband, with dithered signals appearing offset at frequencies $\omega_1$ and $\omega_2$ chosen so that the spectra at the output of the multiplying circuit 55 after squaring of the individual components of the output are separable by filtering as will become apparent presently. The output signal from the circuit 55 is defined by the following mathematical statement.

$$(\tilde{s}_c, \tilde{s}_c) = (s_o s_c) + (s^T\Delta, s^T\Delta)e^{j2\omega 1t} + \beta^2(s^T\gamma, s^T\gamma)e^{j2\omega 2t} + (s_o s^T\Delta)e^{j\omega 1t} + \beta(s_o s^T\gamma)e^{j\omega 2t} + \beta(s^T\Delta, s^T\gamma)e^{j(\omega 1+\omega 2)t} \quad (2)$$

It will be noted by those skilled in the art that compact Hilbert space notations are utilized throughout this disclosure. According to such notations, given complex time functions X(t) and Y(t), define their inner product at time t by $$\langle X, Y\rangle_{T_s} = \frac{1}{T_s}\int_{t-T_s}^{t} X^*(\tau)Y(\tau)d\tau$$

where $T_s$ is a desired integration time.

The self inner product $\langle X,X\rangle$ is usually denoted by metric notation $||X||^2$. Also, the notation (X,Y) will represent the simple product $X^*(t)Y(t)$.

The signal from the complex multiplier circuit 55 is applied to a first input of 3 simple multiplier/mixer type circuits 57, 58 and 59. The mixer 57 has a second input 61 adapted to have a carrier at the frequency $e^{-j\omega 1t}$ applied thereto. The carrier applied to the terminal 61 mixes with the signal from the circuit 55 applied to the other input to remove the carrier from the fourth term of statement (2) above. The fourth term is, thus, reduced to baseband and applied to an input of a correlation circuit 63. An orthogonal sequence generator 65 supplies an orthogonal sequence signal, $\Delta(t)$, to a second input of the correlator 63. While the signal from the generator 65 might be any convenient orthogonal sequence, including sin/cosine, the particular signal utilized in this embodiment is illustrated in FIG. 3. It can be seen from FIG. 3 that the orthogonal sequence signal is composed of a plurality of individual square wave signals of different frequencies. The fourth term of statement (2) reduced to baseband, is correlated with the orthogonal sequence signal $\Delta$, to yield $$\gamma = \langle s_c, (s^T\Delta)\,\Delta\rangle \quad (3)$$

-continued $$= \frac{1}{T_s}\int_{t-T_s}^{t} s_c\left(\sum_{i=1}^{N} s_i(\tau)\delta_i(\tau)\right)\Delta(\tau)d\tau$$

$$= \langle s_o s\rangle + \frac{1}{T_s}\int_{t-T_s}^{t} s_c(\tau)\left(\sum_{\substack{i\neq j\\ i=1}}^{N} s_i(\tau)\delta_i(\tau)\right)\begin{bmatrix}\cdot\\ \cdot\\ \cdot\\ \delta_j(\tau)\\ \cdot\\ \cdot\\ \cdot\end{bmatrix} d\tau$$

In equation (3) above the product $\delta i(\tau)\delta j(\tau)$ is also defined to be a zero mean process, and acts like a chopper signal on the products $s_c(\tau)s_i(\tau)$, so that the second term of equation 3 will be a zero average small perturbation on the first term of the equation, which form U.S. Pat. No. 4,236,158 is recognized as the gradient, $\gamma$. The effect of further integration of equation 3 will further reduce the size of the second term, making its effect negligible.

The second mixer 58 has a second input terminal 67 adapted to receive a carrier at a frequency $e^{-j\omega 2t}$. This carrier is mixed with the signal from the multiplier 55 to reduce the fifth term of equation 2 to baseband. The output of the mixer 58 is supplied through a lowpass filter 69 and a $\beta$ amplifier 71 to the numerator input of a divider 75. Reducing the fifth term of equation 2 to baseband, filtering and amplifying/multiplying by $\beta$ yields $$\beta^2\langle s_o, s^T\gamma\rangle \quad (4)$$

Mixer 59 has a second inputer terminal 77 adapted to receive a carrier at frequency $e^{-j\omega 2t}$. Output of the mixer 59 is supplied through a lowpass filter 79 to a denominator input of the divider 75. The baseband, filtered third term of equation 2 yields $$\beta^2||s^T\gamma||^2 \quad (5)$$

Note that in both the numerator and denominator the operator $(\cdot,\cdot)$ followed by lowpass filtering in filters 69 and 79 is the analog equivalent of the inner product operator $\langle\cdot,\cdot\rangle$, previously defined. Also, the effect of $\beta$ is removed after multiplication in amplifier 71 and division in divider 75. Equation (4) divided by equation (5) equals the optimal gain, $\lambda$. Since the optimal gain, $\lambda$ has been realized, and since the weight w is produced from the gradient, $\gamma$, this circuit must be a true realization of the steepest descent algorithm.

The optimal gain from the output of the divider 75 is applied to one input of a mixer 81. The gradient from the complex multiplier 63 is supplied to a second input of the mixer 81 and to one input of a mixer 83. The output of mixer 81 is supplied through integrators 85 to produce w which is the N component complex weight vector. A second input to mixer 83 is connected to a terminal 87, which is adapted to have a carrier $\beta e^{j\omega 2t}$ supplied thereto. The carrier modulated with the gradient is applied to one input of a summing circuit 89. The complex weight vector is supplied to a second terminal of the summing circuit 89. The orthogonal sequence signals are supplied to one input of a mixer 91. A second input of the mixer 91 has a terminal 93 connected thereto, which terminal 93 is adapted to receive a carrier $e^{j\omega 1t}$ thereon. The carrier modulated by the orthogonal sequence signal is supplied to a third input of the summing circuit 89. The signal at the output of the summing circuit 89 is a combination of the complex weight vector and dithering components, which signal is given by the expression $$\tilde{w}=w+\Delta e^{j\omega 1t}+\beta\gamma e^{j\omega 2t} \quad (6)$$

The output signal from the summing circuit 89 is supplied to an input of a complex multiplier 95. The multiplier 95 also has N auxiliary antennas, represented by the single antenna 96, connected thereto and the output is supplied to the summation circuit 50. Similarly, a main antenna 97 supplies signals to the summation circuit 50. Thus, the signals from the secondary inputs, or auxiliary antennas, are adjusted in weight and dithered by orthogonal sequence signals and the gradient signal at different carrier frequencies so that desired components of the signal produced can be separated and operated upon to arrive at the weight and gradient signals.

Figure 2:
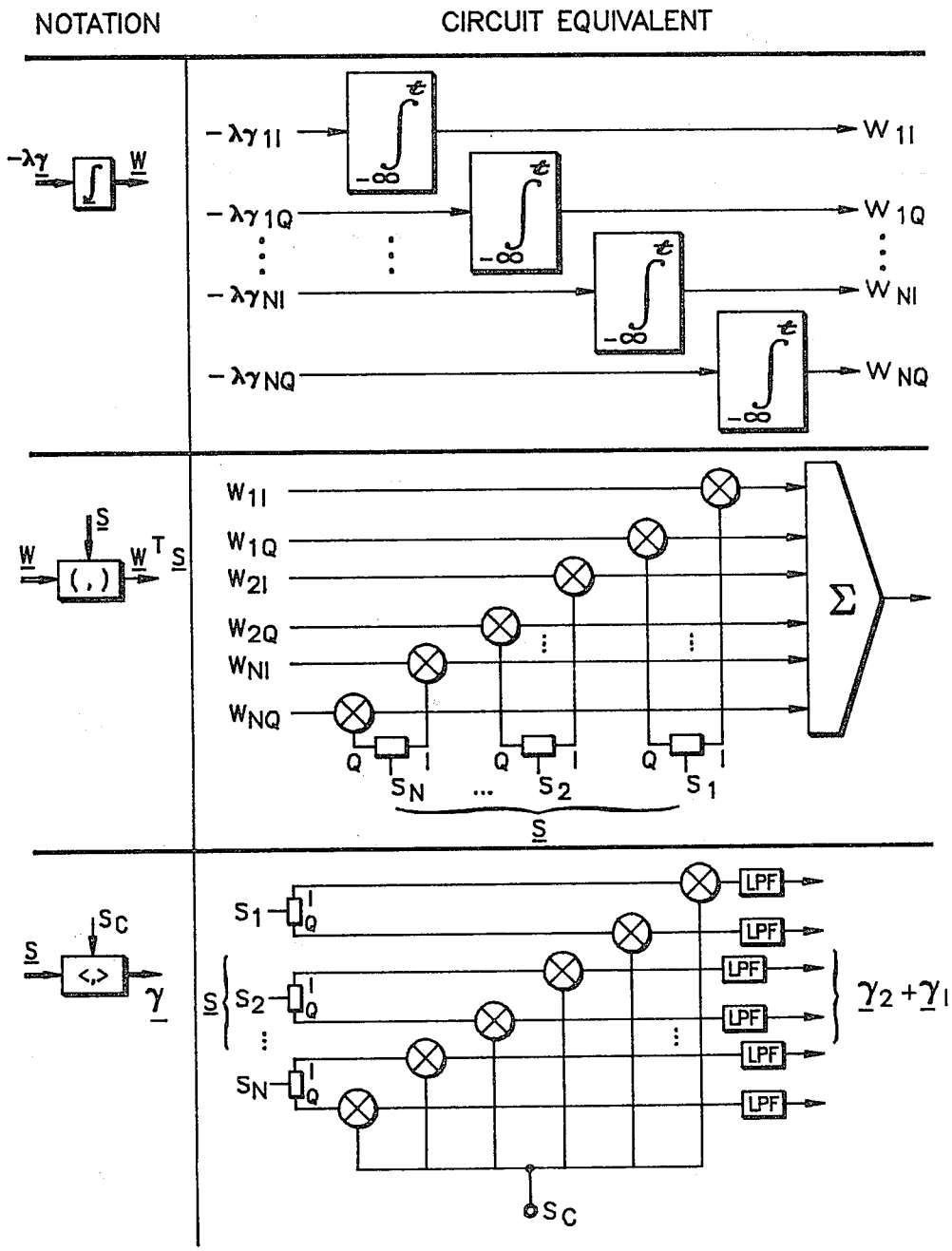
FIG. 2 is a chart of circuit equivalents for mathematical notations utilized in FIG. 1.

Referring specifically to FIG. 2, a chart is illustrated including a list of three mathematical notations in a left hand column and the circuit equivalent for each of these notations in the right hand column. The first mathematical notation in the left hand column is a complex integrator such as integrator 85 in FIG. 1, having a plurality N inputs and providing a plurality N outputs. The equivalent is N simple integrators, 1 in each input line. The second notation is a complex multiplier, such as multiplier 95 in FIG. 1, for multiplying two N component inputs and providing a single output. In the circuit equivalent each of the inputs is divided into an in-phase and a quadrature component. All of the in-phase components of one input signal are multiplied by the in-phase components of the other signal and all of the quadrature components of one signal are multiplied by the quadrature components of the other signal. All of the products are then summed in a summation circuit to produce the single output. The third notation in the left hand column is a second multiplying circuit wherein an N component input is multiplied by a single input to produce an N component output, such as the multiplying circuit 63 in FIG. 1. In the circuit equivalent the N signals of the first input are each divided into an in phase and a quadrature component and each component of each signal is multiplied by the single signal from the other input. All of the products are low pass filtered to provide two N output signals. Thus, specific apparatus for obtaining the steepest descent realization in adaptive signal processing apparatus by dithering the weights is disclosed. It will be realized by those skilled in the art that many variations of the circuitry illustrated may be provided and that the apparatus illustrated is simply for exemplary purposes.

Figure 4A:
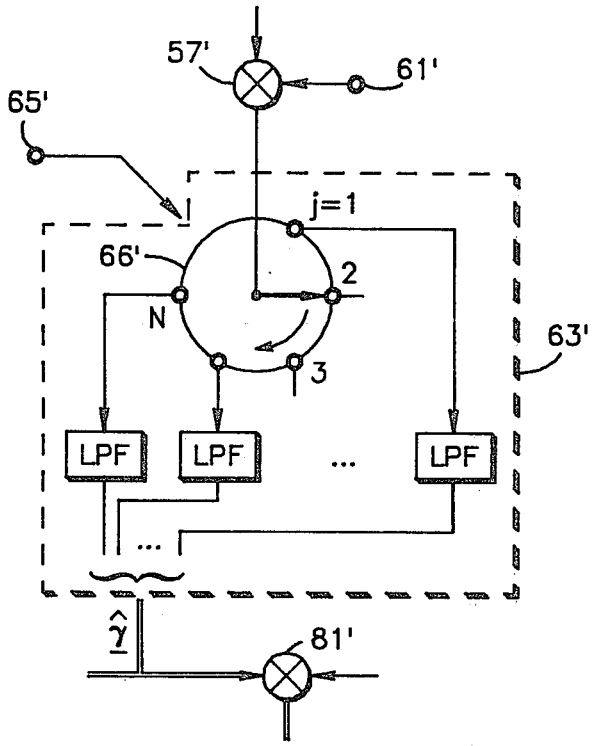
FIG. 4 is a simplified block diagram of a modification of a portion of FIG. 1 to alter the apparatus to sequential gradient control.
Figure 4B:
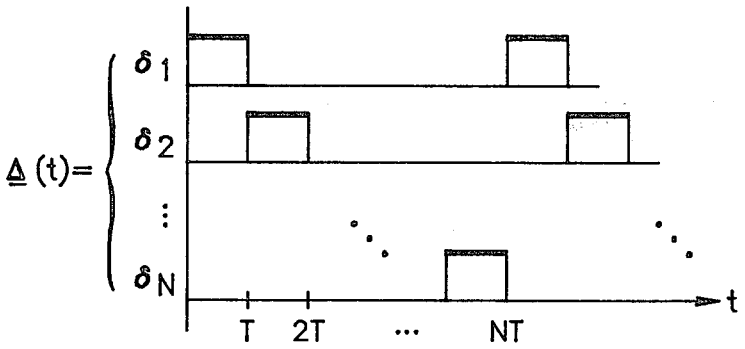

By requiring that the orthogonal sequence signals, $\Delta$, consist of non-time-overlapping pulses, as illustrated in FIG. 4B, the system, in effect, estimates gradient values $\gamma_i$ sequentially and in that case the apparatus of FIG. 1 represents the sequential gradient processor. Now, however, the gradient $\gamma$ in FIG. 1 must be replaced by the modified gradient $\hat{\gamma}$. This rather minor change to the apparatus of FIG. 1 is illustrated in FIG. 4. The apparatus of FIG. 4 is simply a replacement for the complex multiplier 63, remembering that the orthogonal sequence generator 65 produces the signal illustrated in FIG. 4B. Referring specifically to FIG. 4A, components which are similar to those in FIG. 1 are designated by a similar number and all of the numbers have primes added to indicate that it is a different embodiment.

The signal from the orthogonal sequence generator appears at a terminal 65' where it is utilized to control a rotary switch 66', illustrated in simplified schematic form. Each output of the rotary switch 66' is supplied through a low pass filter to the output with all of the outputs from the low pass filters representing the modified gradient, which is then applied to the mixers 81' and 83' as shown in FIG. 1.

An approximation to the accelerated gradient method of adaptive signal processing can be achieved by modifying the baseband term, $s_c$, at the output of the summation circuit 50 in FIG. 1, from $s_c$ to the value $s_c-ks^T\gamma$. In this case the new modified gradient can be written as $$\begin{aligned}\hat{\gamma} &= \langle s_c - ks^T\hat{\gamma}, s\rangle \\ &\equiv \langle s_c, s\rangle - k\langle s, s^T\hat{\gamma}\rangle \\ &= \gamma - k\langle s, s^T\rangle\hat{\gamma} \\ &= \gamma - kC\gamma\end{aligned} \quad (7)$$

where $\gamma$ is the usual gradient vector value and C is the N×N covariance matrix of the signal vector s. Note that here and hereinafter $\langle\cdot,\cdot\rangle$ is understood to operate over a period $T_s$.

From (7), we see that $$\gamma=(I+kC)\hat{\gamma} \quad (8)$$

wherein I=unity matrix.

Hence $$\hat{\gamma}=(I+kC)^{-1}\gamma \quad (9)$$

provided the inverse exists.

Therefore, assuming the inverse exists, subtracting the term $k\,s^T\hat{\gamma}$ from the usual unperturbed value $s_c$ should result in accelerated convergence, by noting that if $k<<1$, $\hat{\gamma}$ in equation 9 looks like the standard steepest descent gradient, while for $k>>1$, $\hat{\gamma}\approx(kC)^{-1}\gamma$, which is the optimal gradient direction in the accelerated gradient method. Note that the optimal gain will stabilize the loop for whatever value $\gamma$ is used.

Figure 5:
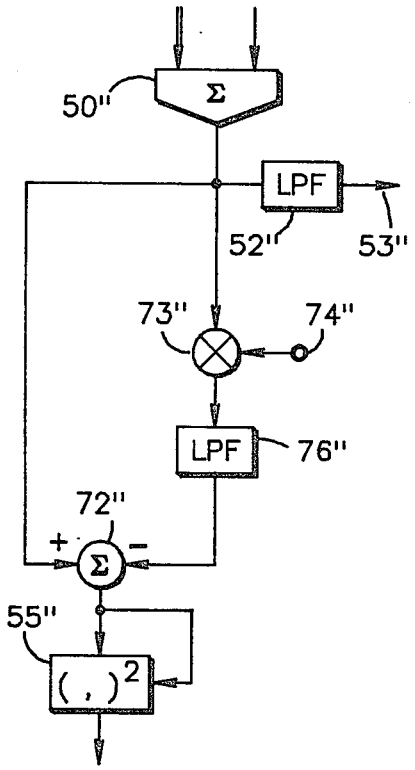
FIG. 5 is another modification of the apparatus of FIG. 1 to alter the apparatus to accelerated gradient control.

Referring specifically to FIG. 5, apparatus is illustrated for modifying the usual unperturbed value $s_c$ from the summation circuit 50 in FIG. 1. The apparatus of FIG. 5 is designated with numbers having a double prime to indicate a different embodiment and components which are similar to the components in FIG. 1 are designated with similar numbers. The output from summation circuit 50'' is supplied through a low pass filter 52'' to an output terminal 53'', as in FIG. 1. The output from the summation circuit 50'' is also supplied directly to a positive input of a summing circuit 72''. In addition the output of the summation circuit 50'' is supplied to one input of a mixing circuit 73'', a second input of which is connected to a terminal 74'' adapted to have the carrier $e^{-j\omega 2t}$ supplied thereto for reducing chosen components of the input signal to baseband in the output thereof. The output of the mixer circuit 73'' is supplied through a low pass filter 76'' to a negative or subtracting input of the summing circuit 72''. The bandwidth of the lowpass filter 76'' is generally $1/T_s$ and the output signal from the lowpass filter 76'' will be $k\,s^T\gamma$. The output of the summing circuit 72'' is supplied to both inputs of a multiplying circuit 55'' to provide the square of the input signal, as in FIG. 1. Thus, the baseband term is modified as described above to provide the accelerated gradient method of adaptive signal processing.

Thus, several embodiments of adaptive signal processing apparatus are disclosed having weight dithered inputs with preselected carriers so that preselected components of the signals are separable for mathematical operations. In this fashion, the gradient and weight terms can be easily determined by utilizing the preselected and separable components. Because each of the separable components has a specific frequency signature, the components can be easily separated with relatively inexpensive and simple hardware. Therefore, the adaptive signal processing apparatus is relatively inexpensive, stable and, because of the various processing algorithms which can be incorporated, has relatively rapid convergence. Further, because all control information for weights is derived after combining and reduction to baseband, IF hardware (such as correlators) and multiple down-converters can be eliminated to further reduce the cost.

While we have shown and described specific embodiments of this invention, further modifications and improvements will occur to those skilled in the art. We desire it to be understood, therefore, that this invention is not limited to the particular forms shown and we intend in the appended claims to cover all modifications which do not depart from the spirit and scope of this invention.

We claim:

1. Adaptive signal processing apparatus for a signal array including a main input and a plurality of secondary inputs, said apparatus comprising:

first means coupled to receive a weight signal, a gradient signal and an orthogonal sequence signal and further coupled to the plurality of secondary inputs for dithering input signals from the plurality of secondary inputs in accordance with the combined weight, gradient and orthogonal sequence signals;

second means coupled to said first means and the main input for combining signals from the main input with the dithered input signals and for developing an output signal, a weight signal and a gradient signal, said weight and gradient signals being coupled to said first means for supplying the dithering signals; and an orthogonal sequence generator coupled to said first and second means for supplying a portion of the dithering signal and for use in developing the gradient signal.

2. Adaptive signal processing apparatus as claimed in claim 1 wherein the second means includes apparatus for impressing the gradient signal on a carrier of a first frequency and for impressing the orthogonal sequence signal on a carrier of a second frequency before coupling the signals to the first means.

3. Adaptive signal processing apparatus as claimed in claim 2 wherein the first means includes multiplying apparatus for multiplying the combined weight, gradient and orthogonal sequence signals by the plurality of secondary inputs to provide a plurality of separable components.

4. Adaptive signal processing apparatus as claimed in claim 3 wherein the main input is coupled to a main antenna and the secondary inputs are coupled to a plurality of secondary antennas.

5. Adaptive signal processing apparatus as claimed in claim 3 wherein the second means includes a summation device coupled to receive the output signals of the multiplying apparatus and the main input, and desired signals are separated from the summation signal by down converting apparatus utilizing carriers of the first and second frequencies.

6. Adaptive signal processing apparatus as claimed in claim 3 wherein the second means includes apparatus for deriving the weight signal and the gradient signal in accordance with steepest descent control.

7. Adaptive signal processing apparatus as claimed in claim 3 wherein the second means includes apparatus for deriving the weight signal and the gradient signal in accordance with accelerated gradient control.

8. An adaptive signal processing method for a signal array comprising the steps of:

multiplying each signal in the array by a dithering signal including a weight signal, an orthogonal sequence signal having a carrier with a first frequency, and a gradient signal having a carrier with a second frequency different than said first frequency;

separating out predetermined components of the multiplied signals according to the frequencies thereof;

operating on the separated components mathematically to produce a weight signal, a gradient signal and a desired output signal;

generating an orthogonal sequence signal; and providing the generated orthogonal sequence signal and the gradient signal with carriers having the first and second frequencies, respectively.

9. An adaptive signal processing method as claimed in claim 8 wherein the step of separating out predetermined components includes multiplying and filtering to select a component with a predetermined carrier and remove the carrier.

* * * * *